US009963976B2

(12) United States Patent
Alpan

(10) Patent No.: US 9,963,976 B2
(45) Date of Patent: May 8, 2018

(54) CORE POSITIONING

(71) Applicant: ROLLS-ROYCE PLC, London (GB)

(72) Inventor: Bogachan Alpan, Derby (GB)

(73) Assignee: ROLLS-ROYCE PLC, London (GB)

( * ) Notice: Subject to any disclaimer, the term of this patent is extended or adjusted under 35 U.S.C. 154(b) by 522 days.

(21) Appl. No.: 14/736,964

(22) Filed: Jun. 11, 2015

(65) Prior Publication Data

US 2015/0377038 A1 Dec. 31, 2015

(30) Foreign Application Priority Data

Jun. 26, 2014 (GB) ..... 1411332.8

(51) Int. Cl.

| | |
|---|---|
| ***B22C 7/02*** | (2006.01) |
| ***B22C 9/04*** | (2006.01) |
| ***B22C 9/10*** | (2006.01) |
| ***B22C 21/14*** | (2006.01) |
| ***F01D 5/28*** | (2006.01) |
| ***F01D 25/00*** | (2006.01) |

(52) U.S. Cl.

CPC ..... *F01D 5/28* (2013.01); *B22C 7/02* (2013.01); *B22C 9/04* (2013.01); *B22C 9/108* (2013.01); *B22C 21/14* (2013.01); *F01D 25/005* (2013.01)

(58) Field of Classification Search

CPC .... B22C 7/02; B22C 9/04; B22C 9/10; B22C 9/108; B22C 9/22; B22C 21/14

USPC ... 164/516, 27, 28, 30, 34, 35, 45, 369, 397

See application file for complete search history.

(56) References Cited

U.S. PATENT DOCUMENTS

| | | | | |
|---|---|---|---|---|
| 4,986,333 A | | 1/1991 | Gartland | |
| 5,295,530 A | * | 3/1994 | O'Connor et al. | B22C 9/04 164/133 |
| 5,623,985 A | | 4/1997 | Wheaton et al. | |
| 5,853,044 A | * | 12/1998 | Wheaton et al. | B22C 7/02 164/30 |
| 5,950,705 A | | 9/1999 | Huang | |

(Continued)

FOREIGN PATENT DOCUMENTS

| | | |
|---|---|---|
| DE | 10 2009 039 255 A1 | 3/2011 |
| GB | 2 281 238 A | 3/1995 |

OTHER PUBLICATIONS

Feb. 24, 2015 Search Report issued in Application No. GB1411332.8.

(Continued)

*Primary Examiner* — Kevin P Kerns
(74) *Attorney, Agent, or Firm* — Oliff PLC

(57) ABSTRACT

A method locates and maintains a core in fixed space relationship within the interior of a shell mold. The method provides at least one pin extending into the core with at least one axial end of the pin protruding from the core. A wax pattern having an outer surface is formed by encasing the core and at least one protruding axial end of the pin in wax such that at least one protruding axial end of the pin terminates at the outer surface of the wax pattern. A shell mold is formed around the wax pattern such that, upon removal of the wax pattern, and in a subsequent casting process for production of hollow metal components, at least one protruding axial end of the pin abuts the shell mold, thus fixing the pin and maintaining a position of the core relative to the mold. The protruding axial end of the pin has an enlarged head.

11 Claims, 1 Drawing Sheet

(56) References Cited

U.S. PATENT DOCUMENTS

| | | | | |
|---|---|---|---|---|
| 6,637,500 | B2 * | 10/2003 | Shah et al. | B22C 9/04 148/404 |
| 2004/0055736 | A1 | 3/2004 | Schneiders et al. | |
| 2005/0189086 | A1 | 9/2005 | Caputo et al. | |
| 2011/0143090 | A1 | 6/2011 | Hillier | |
| 2013/0333855 | A1 * | 12/2013 | Merrill et al. | B22C 7/02 164/45 |

OTHER PUBLICATIONS

Dec. 14, 2015 Search Report issued in European Patent Application No. 15 17 1663.

* cited by examiner

CORE POSITIONING

FIELD OF THE INVENTION

The present invention relates to a method and apparatus for locating and supporting a core in a fixed space relationship in a shell mould and maintaining this fixed space relationship in the subsequent casting process for production of a hollow metal casting.

BACKGROUND OF THE INVENTION

The investment casting process is used to create metal components, e.g. turbine blades and nozzle vane guides, by pouring molten metal into a ceramic shell of the desired final shape and subsequently removing the ceramic shell.

The process is an evolution of the lost-wax process whereby a component of the size and shape required in metal is manufactured using a wax pattern die into which molten wax is injected. The wax pattern is then dipped in ceramic slurry to create a ceramic shell on the wax pattern. The wax is removed and the shell fired to harden it. The resulting ceramic shell has an open cavity of the size and shape of the final component into which the metal can be poured. The ceramic shell is subsequently removed, either physically and/or chemically.

In order to make a component e.g. an aerofoil blade, with internal cavities e.g. internal cooling channels, a ceramic core is required. This is manufactured separately and is placed inside the wax pattern die prior to wax injection.

After casting the metal in the ceramic shell, the ceramic core is removed e.g. leached with alkaline solution, to leave the hollow metal component.

It is important to locate and support the ceramic core in a fixed relationship within the ceramic shell in order to accurately control and thereby ensure consistency in the resulting wall thickness of the hollow metal component after casting.

Various methods are known for locating and supporting the ceramic core within the ceramic shell. A prior art method is shown in FIG. 1. In this prior art method, pins 1 are inserted into the wax pattern 2 until they are in contact with the ceramic core 3. The pins 1 extend from the wax pattern 2 after insertion. The wax pattern 2 is then encased within a ceramic shell 4 which fixes the pins 1 (and the core 3) relative to the ceramic shell 4. Upon removing the wax pattern 2 (by melting) the pins 1 act to maintain the position of the ceramic core 3 within the empty ceramic shell 4 so that as metal is poured into the ceramic shell 4, the ceramic core 3 retains its fixed relationship within the ceramic shell 4.

The pins 1 may be formed of platinum in which case they melt as the metal is cast into the ceramic shell 4. Alternatively, as described in U.S. Pat. No. 4,986,333B, the pins may be made of recrystallized alumina in which case, they remain within the metal component after casting.

Platinum pins are expensive. The cost of platinum pins is of particular concern when casting around elongated, thin ceramic cores which require a considerable number of pins. Furthermore, because platinum pins melt during the metal casting, they may allow movement of the ceramic core as they melt.

Alumina pins are cheaper and, because they remain within the component after casting, they are better able to minimise movement of the ceramic core. However, as acknowledged in U.S. Pat. No. 4,986,333, when the pins are used in the manufacture of gas turbine components such as turbine blades and guide vanes, the alumina pins tend to exit the components under centrifugal force leaving small apertures in the component. In some circumstances, especially when a high number of alumina pins are used, this may be undesirable as it inevitably leads to changes in the cooling system of the component.

Accordingly, there is a need for a method and an apparatus for locating and supporting a core in a fixed space relationship in a shell mould and maintaining this fixed space relationship in the subsequent casting process for production of a hollow metal casting, which ameliorates the problems associated with the prior art pins.

SUMMARY OF THE INVENTION

In a first aspect, the present invention provides a method of locating and maintaining a core in a fixed space relationship within the interior of a shell mould, comprising the steps:

- providing at least one pin extending into the core with at least one axial end of the at least one pin protruding from the core,
- forming a wax pattern having an outer surface by encasing the core and the at least one protruding axial end of the at least one pin in wax such that the at least one protruding axial end of the at least one pin terminates at the outer surface of the wax pattern; and
- forming said shell mould around said wax pattern such that, upon removal of the wax pattern, and in the subsequent casting process for the production of a hollow metal component, the at least one protruding axial end of the pin abuts the shell mould thus fixing the at least one pin and maintaining the position of the core relative to the shell mould.

In exemplary embodiments, the at least one protruding axial end of the at least one pin may have an enlarged head portion.

In a second aspect, the present invention provides an apparatus for locating and maintaining a core in a fixed space relationship within the interior of a shell mould, the apparatus comprising:

- at least one pin extending into the core with at least one axial end of the at least one pin protruding from the core, the core and the at least one protruding axial end of the at least one pin being encased within a wax pattern having an outer surface with the at least one protruding axial end of the at least one pin terminating at the outer surface of the wax pattern, and the wax pattern being encased within said shell mould, such that, upon removal of the wax pattern, and in the subsequent casting process for the production of a hollow metal component, the at least one protruding axial end of the at least one pin abuts the shell mould thus fixing the pin and maintaining the position of the core relative to the shell mould,
- wherein the at least one protruding axial end of the at least one pin has an enlarged head portion.

The method of the first aspect and the apparatus of the second aspect allow for the enlarged head portion of the pin to locate and maintain the position of the core within the shell mould by abutting the shell mould. Since the enlarged head portion of the pin is fully contained within the wax pattern and, therefore, subsequently fully contained within the cast metal of the hollow metal component, the pin is captive within the cast metal thus ensuring that the pin does not exit the metal component, e.g. under centrifugal force.

Optional features of the invention will now be set out. These are applicable singly or in any combination with any aspect of the invention.

In some embodiments, the at least one pin has a respective enlarged head portion at both opposing axial ends.

In some embodiments, the at least one pin extends through the core and has two protruding axial ends each with a respective enlarged head portion.

In some embodiments, the at least one pin extends into the core and has an axial end terminating within the core. The axial end terminating in the core may or may not have an enlarged head portion.

In some embodiments, there is a plurality of pins each extending into or through the core.

The or each pin comprises an axially elongated shaft portion between the opposing axial ends. The shaft portion of the or each pin extends through/into the core.

The or each enlarged head portion has a greater transverse cross sectional profile (i.e. across an axis perpendicular to the axial elongation of the shaft portion of the pin) than the respective shaft portion of the pin(s).

In some embodiments, the shaft portion of the or each pin is completely contained within said core and only the enlarged head portion of the pin at the or each axial end protrudes from the core. In this case, the or each enlarged head portion at the protruding axial end(s) abuts the core (and terminates at the outer surface of the wax pattern) and the axial extension of the or each enlarged head portion matches the depth of the wax in the wax pattern and the desired wall thickness of the hollow cast metal component.

The or each enlarged head portion may be integral with the shaft portion of the respective pin. Alternatively, the or each head portion may be affixed to its respective shaft portion, e.g. by mechanical fixing means such a screw/thread or male/female fixing parts, or by adhesive.

The or each enlarged head portion may have a circular or oblong transverse cross sectional profile.

The or each enlarged head portion may be a semi-spherical shape, or a frusto-conical shape or an ellipsoid shape.

Where the pin has two enlarged head portions at opposing axial ends, the opposing head portions may or may not have the same shape/cross-sectional profile as each other.

The or each pin may be formed of recrystallized alumina but may also be formed of any material having a higher melting point than the metal used for casting. For example, the material of the pin may have a higher melting point than the temperature of the molten metal during casting.

The core may be a ceramic core.

The or each pin may be inserted into the ceramic core before or after firing of the ceramic core. The pin may be adhered to the ceramic core. The pin may be inserted or adhered in its final form or it may be adhered or inserted as a pre-form which is subsequently deformed to its final form.

The shell mould may be a ceramic shell mould. Such a ceramic shell mould may be formed by covering the wax pattern with a ceramic slurry and allowing the ceramic slurry to dry and harden.

After forming the shell mould, the wax pattern is removed (e.g. by melting of the wax) to leave the shell mould containing the core. The core is spaced from the shell mould by the abutment of the enlarged head portion(s) at the protruding axial end(s) of the pin(s) against the inside of the shell mould. In some embodiments, the enlarged head portion(s) also abut the ceramic core.

After firing of the shell mould, molten metal is poured into the shell mould around the core. Upon cooling and solidification of the metal, the enlarged head portion(s) of the protruding axial end(s) of the pin(s) are captive within the cast metal to prevent loss of the pin(s) from the metal component.

On completion of the casting process, the core (e.g. ceramic core) and shell mould (e.g. ceramic shell mould) are removed e.g. chemically and/or physically.

In a third aspect, the present invention provides a cast component e.g. a turbine blade or guide vane having a cavity or channel formed using the method/apparatus of the first/second aspect.

In a fourth aspect, the present invention provides a cast component, e.g. a turbine blade or guide vane, having a body, a cavity or channel formed in the body and a pin protruding into and/or extending across the cavity or channel, wherein the pin has an enlarged head encased within the body of the cast component.

The cavity or channel of the cast component may be formed using the method/apparatus of the first/second aspect.

In a fifth aspect, the present invention provides a gas turbine engine having a cast component according to the third or fourth aspect.

BRIEF DESCRIPTION OF THE DRAWINGS

Embodiments of the invention will now be described by way of example with reference to the accompanying drawings in which.

DETAILED DESCRIPTION

Figure 1:
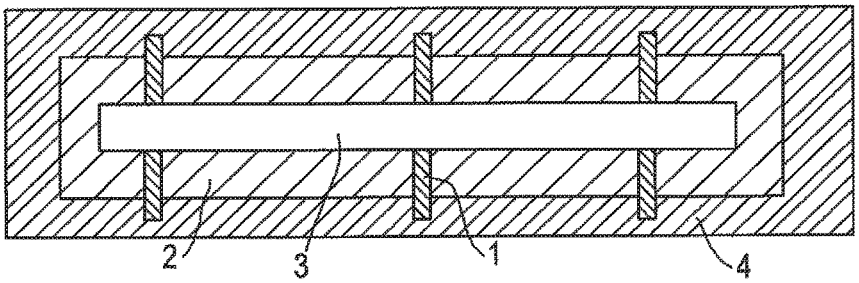
FIG. 1 shows a prior art method/apparatus.
Figure 2:
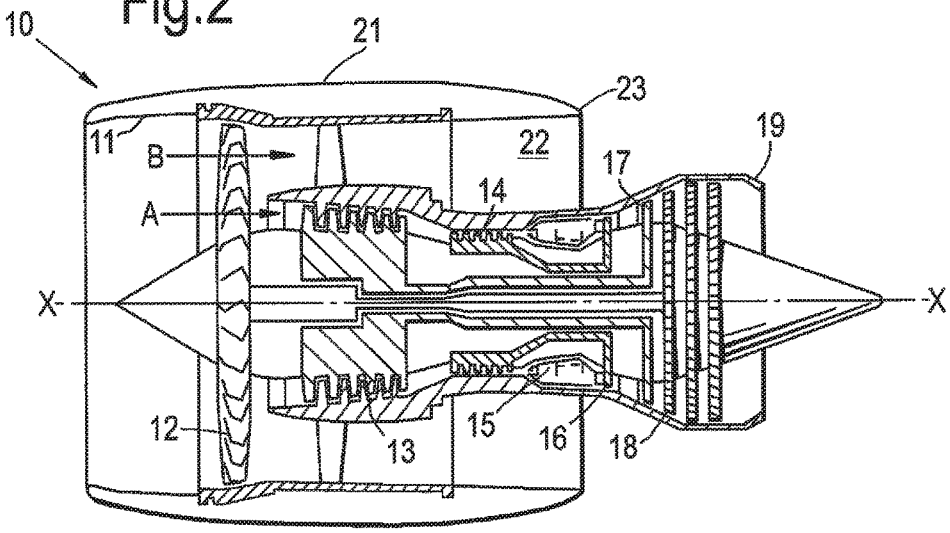
Related Art Fig.2
FIG. 2 shows a ducted fan gas turbine engine incorporating a series of turbines each having aerofoil blades formed using a method according to an embodiment.

With reference to FIG. 2, a ducted fan gas turbine engine incorporating a series of turbines each having a plurality of aerofoil blades formed using a method disclosed herein is generally indicated at 10 and has a principal and rotational axis X-X. The engine comprises, in axial flow series, an air intake 11, the propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Figure 3:
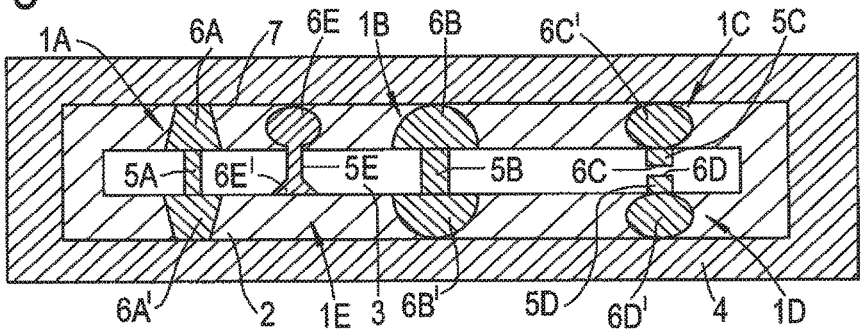
FIG. 3 shows a method/apparatus according to an embodiment.

For forming the turbine blades, an investment casting process is used in which a ceramic core 3 is located and maintained in a fixed space relationship within the interior of a ceramic shell mould 4. This is shown in FIG. 3.

A ceramic core 3 is provided with a plurality of pins 1A, 1B, 1C, 1D and 1E.

Two of the pins 1A, 1B each have a respective axially elongated shaft portion 5A, 5B extending through the ceramic core 3. The shaft portions 5A, 5B are completely contained within the ceramic core with each pin having two protruding opposing axial ends comprising enlarged head portions 6A, 6A', 6B, 6B'. The enlarged head portions 6A, 6A', 6B, 6B' of the pin 1A, 1B are integrally formed with the respective shaft portion 5A, 5B.

Two of pins 1C, 1D form a pair of aligned pins, each having a shaft portion 5C, 5D extending into the ceramic core 3. The shaft portions 5C, 5D are completely contained within the ceramic core as is one axial end 6C, 6D of each pin 1C, 1D. The respective opposing axial ends each comprise an enlarged head portion 6C', 6D'. The enlarged head portions 6C', 6D' are adhesively fixed to the respective shaft portions, 5C, 5D.

Each enlarged head portion 6A, 6A', 6B, 6B', 6C', 6D' abuts the ceramic core.

One of the pins 1E has a shaft portion 5E with opposing axial ends each comprising an enlarged head portion 6E, 6E'. One enlarged head portion 6E protrudes from the ceramic core 3 whilst the other enlarged head portion 6E' is embedded within the ceramic core 3.

In one pin 1A, the enlarged head portions 6A, 6A' are frusto-conical. In one pin, 1B, the enlarged head portions 6B, 6B' are semi-spherical. In the pair of aligned pins, 1C, 1D, the enlarged head portions 6C', 6D' are ellipsoid. In one pin 1E, the protruding enlarged head portion 6E is ellipsoid and the enlarged head portion 6E' embedded within the core is frusto-conical.

A wax pattern 2 having an outer surface 7 is formed by encasing the ceramic core 3 and the enlarged head portions 6A, 6A', 6B, 6B', 6C', 6D', 6E of the pins 1A-1E in wax such that the protruding axial ends of the pins 1A-1E terminate at the outer surface 7 of the wax pattern 2.

The depth of the wax in the wax pattern 2 matches the axial extension of the enlarged head portions 6A, 6A', 6B, 6B', 6C', 6D', 6E of the pins 1A-1E.

The enlarged head portion 6E' of the pin 1E embedded within the ceramic core 3 abuts the inner surface of the wax pattern 2.

A ceramic shell mould 4 is formed around the outer surface 7 of the wax pattern 2 by applying a ceramic slurry to the wax pattern 2 and letting it set and harden. The enlarged head portions 6A, 6A', 6B, 6B', 6C', 6D', 6E of the pins 1A-1E abut the inside of the ceramic shell mould 4.

Upon removal of the wax pattern 2 (by melting), the enlarged head portions 6A, 6A', 6B, 6B', 6C', 6D', 6E of the pins 1A-1E forming the protruding axial ends of the pins 1A-1E are fixed between the ceramic shell mould 4 and the ceramic core 3 thus maintaining the spacing of the ceramic core 3 from the ceramic shell mould 4.

After firing of the ceramic shell mould 4, molten metal is poured into the cavity between the ceramic shell mould 4 and the ceramic core 3 with the enlarged head portions 6A, 6A', 6B, 6B', 6C', 6D', 6E of the pins 1A-1E becoming captive in the cast metal once cooled such that the pins 1A-1E are retained within the turbine blade even under the effect of centrifugal force.

On completion of the casting process, the ceramic core 3 and ceramic shell mould 4 are removed physically and/or chemically.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A method of casting a component comprising:

locating and maintaining a core in a fixed space relationship within an interior of a shell mould comprising:

providing at least one pin extending into the core with at least one axial end of the at least one pin protruding from the core, forming a wax pattern having an outer surface by encasing the core and the at least one protruding axial end of the at least one pin in wax such that the at least one protruding axial end of the at least one pin is flush with the outer surface of the wax pattern; and forming said shell mould around said wax pattern such that, upon removal of the wax pattern, and in a subsequent casting process for production of a hollow metal component, the at least one protruding axial end of the at least one pin abuts the shell mould, thus fixing the at least one pin and maintaining a position of the core relative to the shell mould, after forming the shell mould, removing the wax pattern to leave the shell mould containing the core, firing the shell mould, and pouring molten metal into the shell mould around the core, wherein the at least one protruding axial end of the at least one pin has an enlarged head portion, and the at least one pin is made from a material having a higher melting point than a temperature of the molten metal during casting.

2. The method according to claim 1 wherein the at least one pin extends all the way through the core and has two protruding axial ends each with a respective enlarged head portion.

3. The method according to claim 1 wherein the at least one pin extends into the core and has an axial end terminating within the core.

4. The method according to claim 3 wherein the axial end terminating in the core has an enlarged head portion.

5. The method according to claim 1 wherein there is a plurality of pins each extending into/through the core.

6. The method according to claim 1 wherein the at least one pin comprises an axially elongated shaft portion between the opposing axial ends and the shaft portion of the at least one pin extends through/into the core.

7. The method according to claim 6 wherein the enlarged head portion at the at least one protruding axial end of the at least one pin has a greater transverse cross sectional profile than the respective shaft portion of the at least one pin.

8. The method according to claim 6 wherein the or each enlarged head portion is integral with the respective shaft portion.

9. The method according to claim 1 wherein the at least one pin has a respective enlarged head portion at both axial ends.

10. The method according to claim 1 wherein the or each enlarged head portion has a semi-spherical shape, a frusto-conical shape or an ellipsoid shape.

11. The method according to claim 1 wherein the or each enlarged head portion includes recesses or channels.

* * * * *